US008499668B2

(12) United States Patent
Laib et al.

(10) Patent No.: US 8,499,668 B2
(45) Date of Patent: Aug. 6, 2013

(54) DISCHARGING WORKPIECE PARTS

(75) Inventors: Wolfgang Laib, Besigheim (DE); Eric Schneider, Leonberg (DE); Stefan Buettner, Markgroeningen (DE)

(73) Assignee: TRIUMPF Werkzeugmaschinen GmbH + Co. KG, Ditzingen (DE)

( * ) Notice: Subject to any disclaimer, the term of this patent is extended or adjusted under 35 U.S.C. 154(b) by 301 days.

(21) Appl. No.: 12/581,992

(22) Filed: Oct. 20, 2009

(65) Prior Publication Data

US 2010/0095815 A1 Apr. 22, 2010

(30) Foreign Application Priority Data

Oct. 20, 2008 (EP) ..... 08018301

(51) Int. Cl.
*B62D 7/00* (2006.01)
*B26F 1/14* (2006.01)

(52) U.S. Cl.
USPC ..... 83/23; 83/165; 83/685

(58) Field of Classification Search
USPC ..... 83/23, 165, 685, 55, 14, 19–21, 39, 83/49, 51, 123–128, 686, 821, 683; 30/361, 30/362, 363
See application file for complete search history.

(56) References Cited

U.S. PATENT DOCUMENTS

| | | | | |
|---|---|---|---|---|
| 2,146,780 | A * | 2/1939 | Wales | 83/165 |
| 2,363,630 | A * | 11/1944 | Wales | 83/597 |
| 2,744,575 | A | 5/1956 | Paxhia et al. | |
| 3,583,266 | A * | 6/1971 | Kondo | 83/51 |
| 3,640,167 | A | 2/1972 | Axtmann | |
| 3,739,669 | A | 6/1973 | Seki | |
| 5,136,521 | A | 8/1992 | van Daalen et al. | |
| 6,116,133 | A * | 9/2000 | Nishida | 83/686 |
| 6,408,726 | B1 | 6/2002 | Taijonlahti et al. | |
| 2006/0027626 | A1 | 2/2006 | Endo | |

FOREIGN PATENT DOCUMENTS

| | | |
|---|---|---|
| DE | 69002143 | 3/1994 |
| DE | 69210210 | 10/1996 |
| DE | 69231504 | 5/2001 |
| DE | 69622020 | 1/2003 |
| DE | 102006049044 | 4/2008 |
| EP | 0555604 | 8/1993 |
| EP | 1195207 | 4/2002 |
| EP | 1123169 | 6/2003 |
| JP | 52169893 | 12/1977 |

(Continued)

OTHER PUBLICATIONS

European Search Report from corresponding European Application No. 08 018 301.5, dated Nov. 12, 2009, 9 pages with translation.

*Primary Examiner* — Ghassem Alie
(74) *Attorney, Agent, or Firm* — Fish & Richardson P.C.

(57) ABSTRACT

A machine tool that includes a workpiece support and a punching die. The punching die includes a support surface, for supporting a workpiece to be processed, and a discharging slope. The discharging slope is configured such that a workpiece part, severed from a workpiece supported on the support surface of the punching die, is displaced, in at least one of a rotational, tilting, or linear movement, from a processing position at least partially overlying the discharging slope toward a removal position on the discharging slope. The discharging slope is also configured such that a workpiece part, severed from a workpiece supported on the support surface of the punching die, is directed, in a sliding movement, toward a discharging position located beneath the support surface and adjacent the punching die.

11 Claims, 5 Drawing Sheets

FOREIGN PATENT DOCUMENTS

| | | | |
|---|---|---|---|
| JP | 55165235 | A | 12/1980 |
| JP | 57194743 | | 12/1982 |
| JP | 04 043416 | | 4/1992 |
| JP | 443416 | | 4/1992 |
| WO | 2008049079 | | 4/2008 |
| WO | WO2008049079 | A1 | 4/2008 |

* cited by examiner

DISCHARGING WORKPIECE PARTS

CROSS REFERENCE TO RELATED APPLICATION

This application claims priority under 35 U.S.C. §119(a) to European Application No. 08 018 301.5, filed on Oct. 20, 2008, which is hereby incorporated by reference in its entirety.

TECHNICAL FIELD

The invention relates to discharging workpiece parts, and, in particular, to discharging workpiece parts that have been severed from plate workpieces, e.g., via a punching operation.

BACKGROUND

Workpiece parts lying on a support surface of a punching die at a punching/forming station of a machine tool following processing by severing can be discharged by being pushed through a remaining frame of a workpiece. In some cases, a stripper is provided on a punching tool or a punch of the machine tool. The stripper serves as a guide to aid in pushing the severed workpiece part through the remaining frame of the workpiece. However, the use of a stripper may present problems for formed workpiece parts, because formed features produced on the workpiece part may act as an obstructing contour. Workpiece parts that have formed features (e.g. threaded rim holes, louvers, offsets, beads etc.) may not be reliably discharged, and, therefore, they may remain joined to the (remaining) workpiece by so-called micro joints which may necessitate manual finishing (breaking-off/deburring). Even in the case of workpiece parts not having formed features, pushing the severed workpiece part through the remaining frame of the workpiece can result in a loss of time and low process reliability.

US 2006/0027626 A1 discloses a machine tool on which both forming and processing of a workpiece part by severing can be performed with the use of punching die. A workpiece part joined to a remaining portion of a workpiece via a micro joint is first bent downward at a bending edge of an orifice in the punching die. Then, the micro-joint is positioned at the bending edge and the formed workpiece is severed from the remaining workpiece by a punching operation. The workpiece part severed from the remaining portion of the workpiece is then discharged through the orifice in the punching die. In this case, the size of the workpiece parts to be discharged may be limited to the size of the orifice. The workpiece parts severed from the remaining portion of the workpiece may not fall with a controlled movement and may therefore strike against the edges of the orifice and be damaged.

SUMMARY

In general, this invention relates to discharging workpiece parts, and, in particular, to discharging workpiece parts that have been severed from plate workpieces, e.g., via a punching operation.

One aspect of the invention features a machine tool that includes a workpiece support and a punching die. The punching die includes a support surface, for supporting a workpiece to be processed, and a discharging slope. The discharging slope is configured such that a workpiece part, severed from a workpiece supported on the support surface of the punching die, is displaced, in at least one of a rotational, tilting, or linear movement, from a processing position at least partially overlying the discharging slope toward a removal position on the discharging slope. The discharging slope is also configured such that a workpiece part, severed from a workpiece supported on the support surface of the punching die slides toward a discharging position located beneath the support surface and adjacent the punching die.

In some embodiments, the punching die also includes an edge along a periphery of the support surface. The edge is arranged between the discharging slope and the support surface.

In certain embodiments, the punching die also includes a die cutting face disposed between the edge and the discharging slope.

In some embodiments, the support surface includes at least one orifice adapted to receive a punch.

In certain embodiments, at least part of the discharging slope is arranged beneath the at least one orifice.

In some embodiments, the machine tool also includes a slide arranged at the discharging position.

In certain embodiments, the punching die has a frustopyramidal or a frustoconical shape. The discharging slope can be defined by a lateral surface of the frustopyramidal or the frustoconical shape.

In some embodiments, the machine tool also includes a die holder configured to support the punching die. A lower edge of the discharging slope abuts the die holder when the punching die is supported in the die holder.

In certain embodiments, the support surface is arranged at an angle of about 20° to about 80°, e.g., about 25° to about 45°, relative to the discharging slope.

In some embodiments, the machine tool also includes a control unit operable to control movements of a workpiece relative to the punching die allowing a workpiece part, connected to the workpiece, to be positioned such that a center of gravity of the workpiece part overlies the discharging slope.

In certain embodiments, the machine tool also includes a die holder configured to support the punching die, a punch holder configured to support a punch, and a drive unit operable to control relative movements of the die holder and the punch holder along a stroke axis.

Another aspect of the invention provides a method that includes severing a workpiece part from a workpiece supported on a support surface of a punching die. The workpiece part is displaced, in at least one of a rotational, tilting, or linear movement, from a processing position at least partially overlying a discharging slope of the punching die toward a removal position on the discharging slope. The workpiece part slides from the removal position toward a discharging position located beneath a workpiece support and adjacent to the punching die.

In some embodiments, the method includes supporting the punching die in a die holder and moving the die holder along a stroke axis until the discharging slope adjoins a slide arranged at the discharging position.

In certain embodiments, the method also includes positioning the workpiece part such that a center of gravity of the workpiece part overlies discharging slope prior to severing the workpiece part from the workpiece.

In some embodiments, severing the workpiece part from the workpiece includes performing a punching operation on the workpiece at an orifice in the support surface of the punching die.

In certain embodiments, severing the workpiece part from the workpiece includes performing a punching operation on the workpiece at a die-cutting face arranged between the discharging slope and the support surface of the punching die.

In another aspect, the invention features a punching die that includes a support surface for supporting a workpiece to be processed and an edge along a periphery of the support surface. The punching die also includes a discharging slope, for discharging a workpiece part severed from a workpiece supported on the support surface. The punching die further includes at least one of (i) a die cutting face disposed between the edge and the discharging slope, and (ii) an orifice adapted to receive a punch, at least part of the discharging slope being arranged beneath the orifice.

In another aspect, the invention provides a machine tool in which a workpiece part, severed from a remaining portion of a workpiece, can be brought from a processing position, by a rotational, tilting and/or linear movement, to a removal position on a discharging slope formed on a punching die. The workpiece part can be displaced along the discharging slope by a sliding movement, to a discharging position that is located beneath a workpiece support and adjacent to the punching die.

In some embodiments, the workpiece part is first brought from the processing position by a rotational, tilting and/or linear movement to a removal position on the discharging slope of the punching die in order for the workpiece part then to be brought by a sliding movement to a discharging position situated beside the punching die. This can allow the workpiece part to be discharged from the punching die in a controlled manner and without the use of a stripper serving as a guide. It may also be possible for workpieces having a downwardly formed feature to be supported in the processing position since the discharging slope on the punching die forms a space into which the formed feature can extend. It will be appreciated that the discharging slope does not necessarily have to be a plane surface but may, where appropriate, have a curvature. The machine tool may also be configured in such a manner that the punching die and the punch may be replaced by other tool punches and tool dies, especially by punches and dies that make it possible to faun the workpiece or the partially cut-free workpiece part.

In certain embodiments, an edge is formed at an outer periphery of the support surface of the punching die. The edge is adjoined by the discharging slope. In the processing position, the workpiece part may project partly beyond the support surface. After being cut free, at an orifice in the support surface, the workpiece part executes a tilting movement about the edge. The workpiece can be arranged such that, in the processing position, the center of gravity is arranged at least partially over the discharging slope.

In some embodiments, the punching die includes a die-cutting face that is formed between the edge and the discharging slope of the punching die. The die-cutting face can extend at a right angle to the (horizontal) support surface. The workpiece part that is to be cut free from the remaining portion of the workpiece projects in the processing position beyond the support surface in the horizontal direction. Thus, in the processing position, the workpiece part does not lie on the support surface. The workpiece part can be severed from the remaining portion of the workpiece by lowering a punch along the die-cutting face with a stroke movement, such that the workpiece part is cut free from the remaining portion of the workpiece supported on the support surface. The severed workpiece part can be lowered, e.g., under gravity, onto the discharging slope with a combined linear and rotational movement.

In certain embodiments, the support surface has at least one orifice that is arranged to be engaged by a punch. The workpiece can be processed by punching at the orifice to sever the workpiece part from the remaining portion of the workpiece. The workpiece part cut free at the orifice may be brought onto the discharging slope by executing a tilting movement about an edge at the outer periphery of the support surface. The edge may boarder the discharging slope. The punching die can also include a die-cutting face arranged between the edge and the discharging slope. It may be possible to process a workpiece at the orifice or to sever the workpiece part from the remaining portion of the workpiece at the die-cutting face by means of a punch with a cutting edge that is off-center in relation to the rotation axis of the tool and which can be selectively positioned, by a rotational movement, over the orifice or over the die-cutting face. For processing the workpiece by severing, the dimension of the orifice may substantially correspond to the dimensions of the cutting edge formed on the punch. It is also possible for the orifice to be used for ejecting workpiece parts, which are brought to a discharging position provided beneath the punching die through the orifice of the punching die.

In some embodiments, the discharging slope of the punching die is arranged beneath the orifice in the support surface. The workpiece part that is to be cut off can be positioned in the processing position over the orifice and can be severed, by a punching operation, from the remaining portion of the workpiece supported. For discharging large workpiece parts, the support surface may form a relatively narrow encircling rim of the punching die, delimiting an orifice of large surface area, especially a circular orifice, in the punching die.

In some embodiments, the machine tool can include a slide that adjoins the discharging slope of the punching die. The slide can be arranged at the discharging position. The slide can be arranged in such a manner that its upper edge is adjacent to a lower edge of the discharging slope, so that the sliding movement of the workpiece part can continue onto the slide in order for the workpiece part to be discharged from the machine tool. The slope of the slide may correspond, at least in the portion adjoining the discharging slope, to that of the discharging slope, thereby helping to ensure continuous movement. In some cases, other transport means, for example conveyor belts, that enable the workpiece part to be discharged may also be arranged at the discharging position.

In some embodiments, the discharging slope is formed on a lateral surface of a frustopyramidal or frustoconical punching die. The support surface for a punching die with such a geometry can be arranged at the top of the conical or pyramidal frustum. The support surface of the frustopyramidal or frustoconical punching die can include an orifice for engagement by a punch. The lateral surface of the conical frustum or the lateral surfaces of the pyramidal frustum form one or more inclined planes along which the workpiece part can slide. In addition to using frustopyramidal or frustoconical punching dies, it is also possible to use punching dies having other geometries, such as asymmetrical geometries.

In certain embodiments, the punching die is supported in a die holder such that a lower edge of the discharging slope abuts on the die holder. This can help to minimize the stroke movement required to position the die holder. The periphery of the die holder may also have a slope, thereby helping to ensure a continuous transfer of the workpiece part from the punching die to the discharging position.

In some embodiments, the support surface forms an angle of about 20° to about 80°, e.g., about 25° to about 45°, with the discharging slope. This angle can help to provide a controlled transfer from the processing position to the removal position. As used herein, the term "edge" may also refer to a rounded edge at which tilting of the workpiece part may take place.

The machine tool can also include a control unit for positioning the workpiece part in the processing position in such a way that the center of gravity of the workpiece part lies over the discharging slope. This can help to ensure that, after being processed by severing, the workpiece part executes a tilting or rotational movement, under gravity, about an edge provided at the periphery of the support surface and is thereby brought from the processing position to the removal position. In situations in which the workpiece part is severed from the remaining workpiece at an orifice formed in the support surface, for a given contour of the workpiece part the control unit is able to specify the order of the portions of the contour which are to be cut during punching in such a manner that the last portion of the contour to be cut at the orifice is at a distance from the center of gravity of the workpiece part that is greater than the distance to the tilting edge.

In certain embodiments, the machine tool additionally includes a die holder, in which the punching die is supported, a punch holder, in which a punch is supported, and a drive unit by means of which the punch holder and the die holder are movable towards each other along a stroke axis in order to process the workpiece part in the processing position by severing. When processing by severing, the punch is inserted into an orifice formed in the support surface of the punching die or is guided along the die-cutting face in order to sever the workpiece part from the remaining workpiece. In addition to the drive unit, a further drive unit may be provided by means of which the die holder and/or the punch holder may be rotated about the stroke axis in order to rotate the punching die in such a way that the lower end of the discharging slope is arranged adjacent to the discharging position.

In yet another aspect, the invention features a method in which a workpiece part is brought from a processing position, e.g., under gravity, by a rotational, tilting and/or linear movement, to a removal position on a discharging slope formed on a punching die. The workpiece part is brought along the discharging slope by a sliding movement, e.g., under gravity, to a removal position provided beneath a workpiece support and adjacent to the punching die. The method can allow for workpiece parts to be reliably and rapidly discharged from a punching die.

In some embodiments, the punching die is supported in a die holder. The die holder is moved, before or after processing by severing, along a stroke axis until the discharging slope of the punching die adjoins a slide of a machine tool located at the removal position. The die holder may already be arranged in the processing position in such a way that the discharging slope adjoins the slide. It is also possible for the die holder to be moved downward such that a lower edge of the discharging slope is positioned adjacent to the slide only after processing by severing, i.e., while the workpiece part is sliding along the discharging slope. That can advantageous to create more space for discharging beneath the workpiece support or if processing of a workpiece part is to take place above or below the workpiece plane.

In certain embodiments, the workpiece part can be positioned in the processing position in such a way that the center of gravity of the workpiece part lies over the discharging slope. As explained above, the portion of the contour of the workpiece part that is to be severed last may be selected such that the distance of that portion from the center of gravity of the workpiece part is greater than the distance to the tilting edge, with the result that the workpiece part executes a tilting movement under the effect of gravity.

In some embodiments, the workpiece is selectively processed by punching either at an orifice in the support surface of the punching die or at a die-cutting face provided between an edge formed at the outer periphery of the support surface and the discharging slope of the punching die. In this regard, the punch and/or the punching die may be rotated about a rotation axis in order to position the punch selectively over the orifice or over the die-cutting face or the cutting edge.

In some cases, the punching die may include a plurality of orifices for engagement by a punch. In such cases, the punching die may be rotated into and fixed in more than two different positions relative to the punch, such as described in DE 10 2006 049 044, which is incorporated herein by reference.

Other aspects, features, and advantages will be apparent from the description and the drawings, and from the claims.

DETAILED DESCRIPTION

Figure 1:
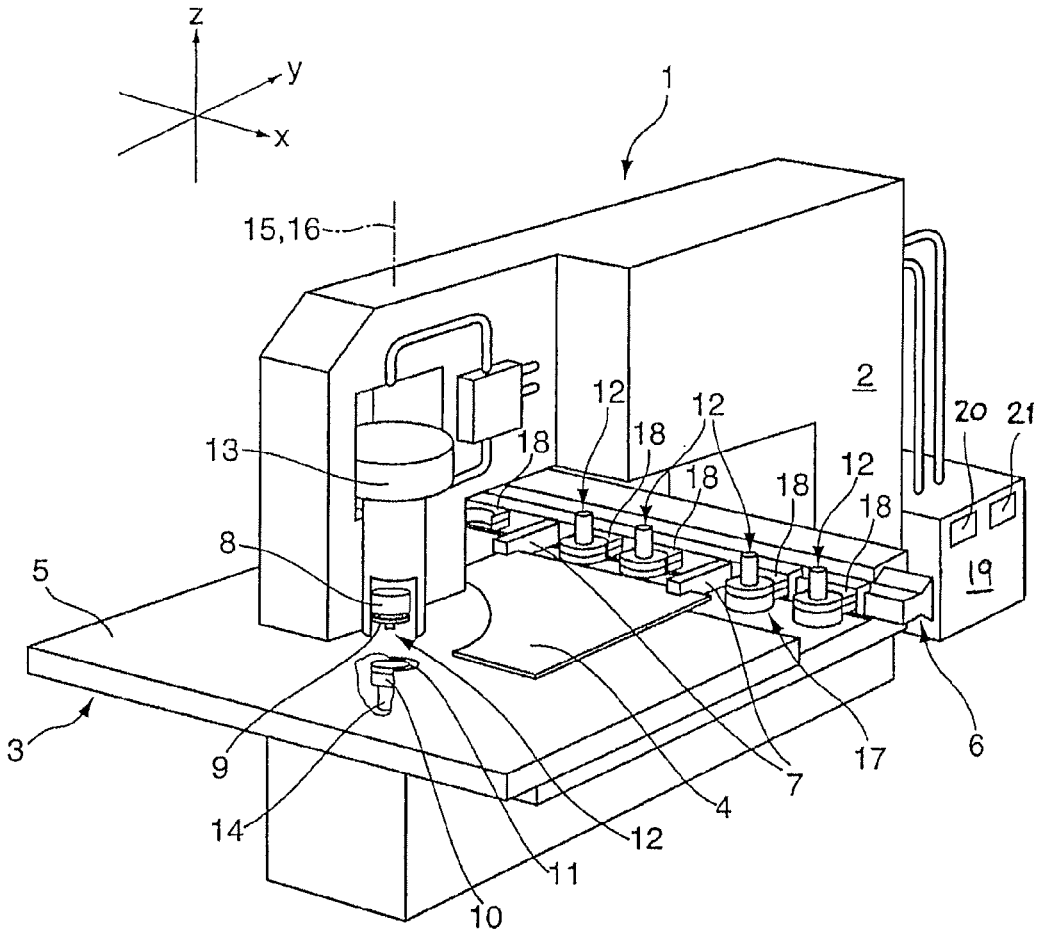
FIG. 1 is a perspective view of a machine tool.

FIG. 1 shows a machine tool 1 for cutting and/or forming plate-like workpieces, in the form of a punching/forming machine for processing metal sheets. The punching/forming machine 1 has a C-shaped machine frame 2 having, arranged in a throat thereof, a workpiece support in the form of a workpiece table 3. The workpiece table 3 supports a workpiece, e.g., a metal sheet 4, to be processed. On an upper side, the workpiece table 3 forms a horizontal support plane 5 for the metal sheet 4 to be processed. The support plane 5 extends parallel to the x/y plane of the coordinate system shown in FIG. 1. The metal sheet 4 is clamped in position by clamps 7. A coordinate guide 6 can be used to move the metal sheet 4 in the support plane 5 of the workpiece table 3.

A punch holder 8 is arranged at a front end of an upper arm of the C-shaped machine frame 2. The punch holder 8 supports a punch 9. A die holder 10 is arranged at a front end of a lower arm of the C-shaped machine frame 2. The die holder 10 supports a punching die 11. The punch 9 and the punching die 11 form a tool 12 for processing the metal sheet 4 by severing.

A drive unit of the punching/forming machine 1 is formed by a punch drive 13 and a die drive 14 in the form of linear drives. By means of the punch drive 13, the punch holder 8 together with the punch 9 supported thereon and secured thereto can be raised and lowered relative to the workpiece table 3 along a stroke axis 15. In a comparable manner, the die holder 10 together with the punching die 11 supported therein and secured thereto can be raised and lowered relative to the workpiece table 3 along the stroke axis 15 by means of the die drive 14. In addition, the punch holder 8 and the die holder 10 can be adjusted independently of each other with regard to their rotational position about a tool rotation axis 16, which is identical to the stroke axis 15, by means of a rotary drive.

A linear magazine 17 with additional tools 12 is provided on the coordinate guide 6. The tools 12 situated in the linear magazine 17 are each held by a tool cassette 18 and can each be secured to the punch holder 8 and the die holder 10 as required for processing the metal sheet 4. It is also possible for tools 12 for forming the workpiece 4 to be kept in the linear magazine 17.

During tool-changing and during workpiece processing, all of the drives of the punching/forming machine 1 are controlled by means of a numerical control unit 19. The numerical control unit 19 includes a storage means 20 (e.g., electronic memory) for storing tool data and, in addition, a control means 21 (e.g., microcontroller) for calculating and controlling both the raising, lowering and rotational movements of the punch holder 8 and the raising, lowering and rotational movements of the die holder 10 based on the stored data relating to the workpiece 4 and the tool 12.

Figure 2A:
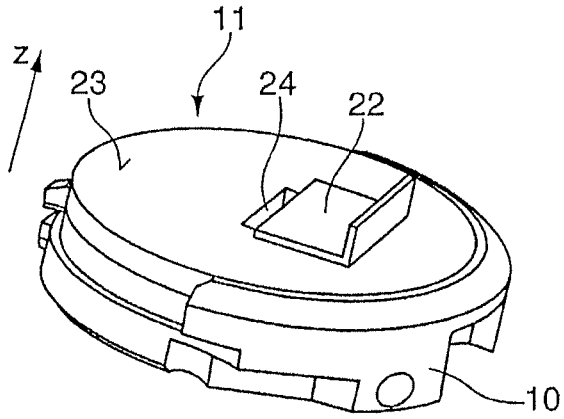
FIG. 2*a* is a perspective view of a formed workpiece part on a support surface of a punching die that does not include a discharging slope.

FIG. 2*a* shows a detailed view of the punching die 11 of FIG. 1 supported in the die holder 10. A formed workpiece part 22 is shown lying on a plane support surface 23 of the punching die 11. The workpiece part 22 has been cut off the workpiece 4 shown in FIG. 1 by punching along an orifice 24 formed in the support surface 23. The separated workpiece part 22 can be discharged by being pushed, which may be done, for example, with the aid of a stripper on the punch 9 (e.g. in the form of an Eladur spring) forming a guide. In that case, however, the formed feature produced on the workpiece part 22 may act as an obstructing contour.

Figure 2B:
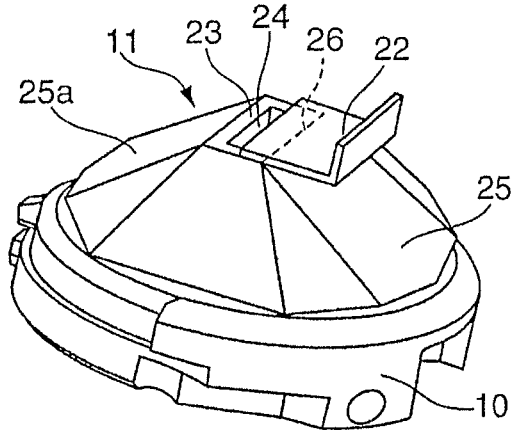
FIGS. 2*b* and 2*c* are perspective views of a formed workpiece part on a support surface of a punching die that includes a discharging slope.
Figure 2C:
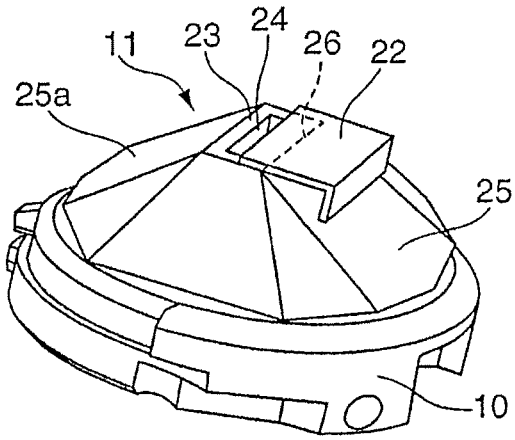

FIGS. 2*b* and 2*c*, illustrate a punching die 11 that has a frustopyramidal geometry. A top surface of the pyramidal frustum forms a support surface 23 for the workpiece part 22 and a lateral surface of the pyramidal frustum serves as a discharging slope 25. This geometry can allow pushing to be dispensed with. As shown in FIG. 2*b* and FIG. 2*c*, following processing by severing, the workpiece part 22 which has been formed upward (FIG. 2*b*) or downward (FIG. 2*c*) lies only partly on the support surface 23 and can be discharged along the discharging slope 25. The diameter of the punching die 11 or the die holder 10 can be approximately 100 mm.

Figure 3A:
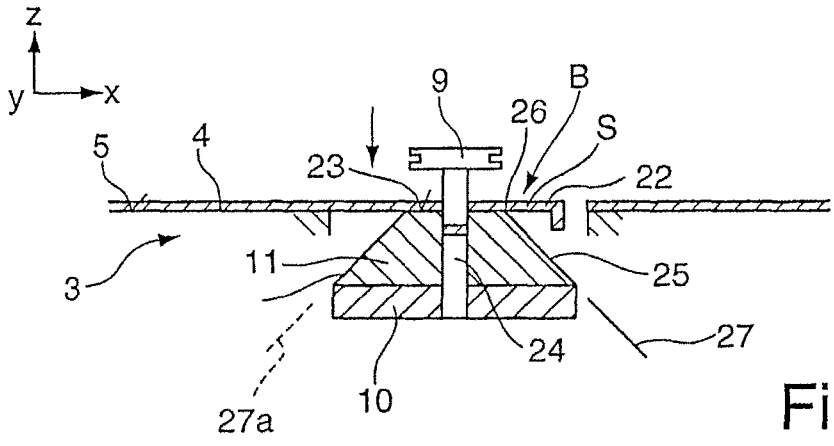
FIGS. 3*a-c* illustrate a punching operation in which a workpiece part is discharged from a remaining portion of a workpiece using the punching die of FIG. 2*c*.
Figure 3B:
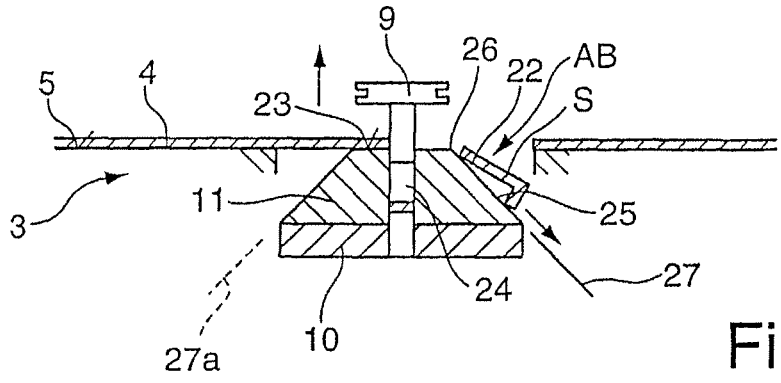

FIG. 3*a* shows the workpiece part 22 in a processing position B in which, as shown in FIG. 2*c*, it lies on the support surface 23 of the punching die 11 and is severed from the remaining portion of the workpiece 4 as the punch 9 engages with the orifice 24. As may also be seen in FIG. 3*a*, after being processed by severing, the workpiece part 22 is situated with its center of gravity S over the discharging slope 25. To cause that to happen, the cutting of the contour of the workpiece part 22 can be planned in the control unit 19 in such a way that, when the final severing cut is made, the center of gravity S is at such a distance from the orifice 24 that it no longer lies on the support surface 23. After the workpiece part 22 is severed from the remaining portion of the workpiece 4, the workpiece part 22 tilts under gravity about a tilting edge 26, formed at the periphery of the support surface 23, from the processing position B into a removal position AB. In the removal position, the workpiece part 22 lies on the discharging slope 25 of the punching die 11 (as shown in FIG. 3*b*). The discharging slope 25 is inclined with respect to the support surface 23 of the punching die 11, or the workpiece plane 5, by a tilt angle $\alpha$, e.g., about 45°.

The workpiece part 22 subsequently slides under gravity along the discharging slope 25 of the punching die 11 to a discharging position AS (see, e.g., FIG. 3*c*) in which the workpiece part 22 lies on a rigid slide 27 that adjoins the discharging slope 25 and on which the workpiece part 22 continues to slide in order to be discharged from the machine tool 1. In the discharging operation described above, the support surface 23 of the punching die 11 lies in the workpiece plane 5 in order to support the workpiece part 22 during the punching operation. For this, the die holder 10 can be positioned, prior to processing by punching, below the workpiece plane 5. The die holder 10 is typically lowered by approximately 30 mm relative to the workpiece plane 5.

It is also possible for workpiece parts 22 formed, for example, by roll-forming to be processed above or below the workpiece plane 5 by the punching die 11 shown in FIGS. 2*b* and 2*c* if a discharging position AS is suitably provided. In that case, movement of the punching die 11 along the stroke axis 15 to the position shown in FIGS. 3*a-c* can be carried out after processing by punching, while the workpiece part is sliding along the discharging slope 25. In some cases, instead of a rigid slide 27 being provided, a slide that is movable along the stroke axis 15 may be provided or a different transport device, such as a conveyor belt, may be provided for discharging the workpiece part 22 at the discharging position AS.

In the manner described above, the workpiece part 22 can be rapidly removed from the workpiece plane 5 and at the same time, where applicable, displacement of the workpiece 4 along the workpiece plane 5 for a subsequent processing operation may already take place while the workpiece part 22 is sliding along the discharging slope 25. The punching die 11 can also include further lateral surfaces that can be used as the discharging slope. For example the punching die 11 may also include an opposite lateral surface 25*a* which may be adjoined by a further slide 27*a* indicated in FIGS. 3*a-c* by a broken line. The punching die 11 also does not necessarily have to be frustopyramidal but may also have another configuration, such as frustoconical or asymmetrical.

Figure 4A:
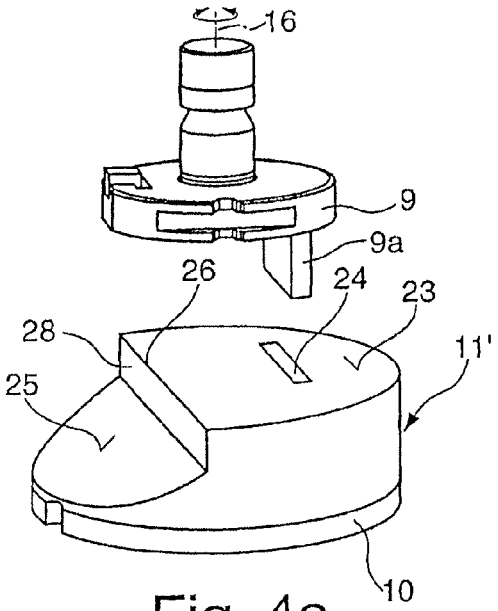
FIGS. 4*a* and 4*b* are perspective views of a punch with an off-center cutting edge and a punching die with a die-cutting face arranged off-center.
Figure 4B:
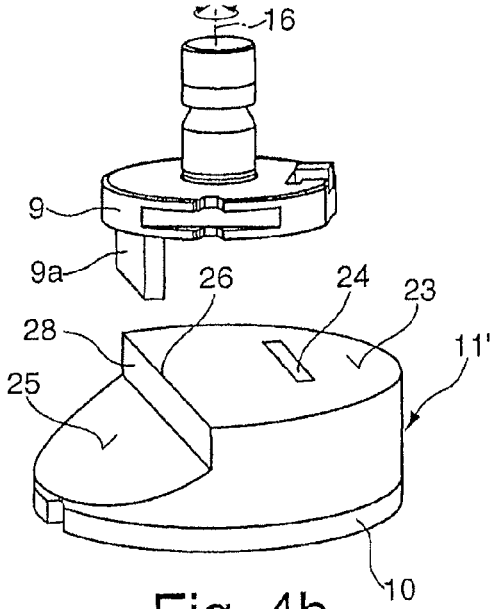

FIGS. 4*a* and 4*b* show an asymmetrical punching die 11' that includes a support surface 23 having an orifice 24, for engagement by the punch 9, and a die-cutting face 28. The orifice 24 and the die-cutting face 28 are arranged off-center. The die-cutting face 28 extends in the vertical direction (Z-direction) and is formed between an edge 26 and a discharging slope 25. The punch 9, which is likewise asymmetrical, may be selectively positioned by 180° rotation about the rotation axis 16 with a cutting edge 9*a* over the orifice 24 (FIG. 4*a*) or over the die-cutting face 28 or at the edge 26 (FIG. 4*b*). The workpiece 4 can be selectively processed by bringing the punch 9 or the cutting edge 9*a* into engagement with the orifice 24 or by guiding the punch 9 or the cutting edge 9*a* along the die-cutting face 28. The orifice 24 may also be made wider towards the center of the punching die 11' in order to allow workpiece parts to be ejected through the orifice 24. In addition, the punch 9 and the punching die 11' may also be configured as a forming tool by means of which forming may be performed on the workpiece in addition to die-cutting at the position shown in FIG. 4*a*.

Figure 5A:
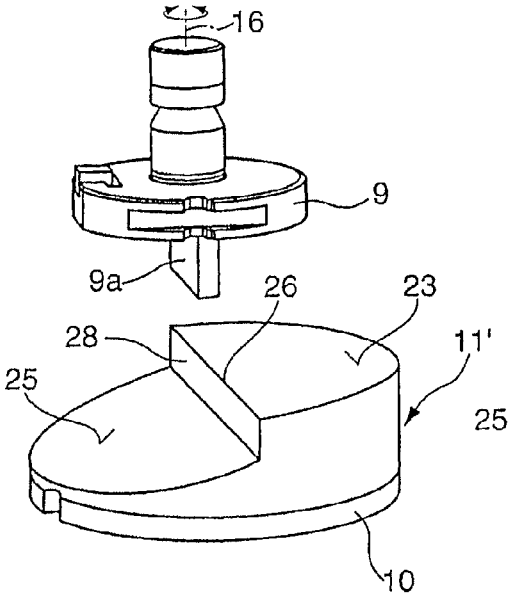
FIG. 5*a* is a perspective view of a punching die with a central die-cutting face.

As shown in FIG. 5*a*, the edge 26 for die-cutting the workpiece may also be arranged centrally on the punching die 11'. In that case, the central cutting edge 9*a* of the punch 9 can be lowered onto the punching die 11' in order to die-cut the workpiece part at the cutting edge 26 or along the die-cutting face 28. No orifice is provided in the support surface 23 of the punching die 11' here since rotation of the punch 9 and/or the punching die 11' does not offer any additional possibilities for processing the workpiece in this case.

Figure 5B:
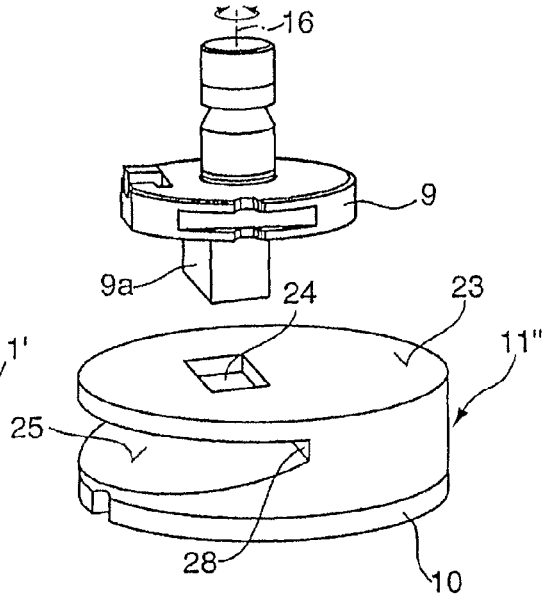
FIG. 5*b* is a perspective view of a punching die having a discharging slope arrange beneath an orifice in a support surface of the punching die.

FIG. 5*b* shows a further punching die 11" where the discharging slope 25 is disposed beneath the orifice 24 in the support surface 23. The punch 9 has in this case a cutting edge 9*a* that can be brought into engagement with the orifice 24 in order to sever a workpiece part positioned over the orifice 24 from the remaining workpiece. In this case, a severed workpiece part can be lowered onto the discharging slope 25 in a combined linear and rotational movement. An additional orifice for processing a workpiece by punching may be made in the right-hand portion of the support surface 23. For discharging large workpiece parts, the discharging slope may extend over almost the entire cross-section of the punching die 11', in which case the support surface is formed by a narrow, for example annular, rim.

Figure 3C:
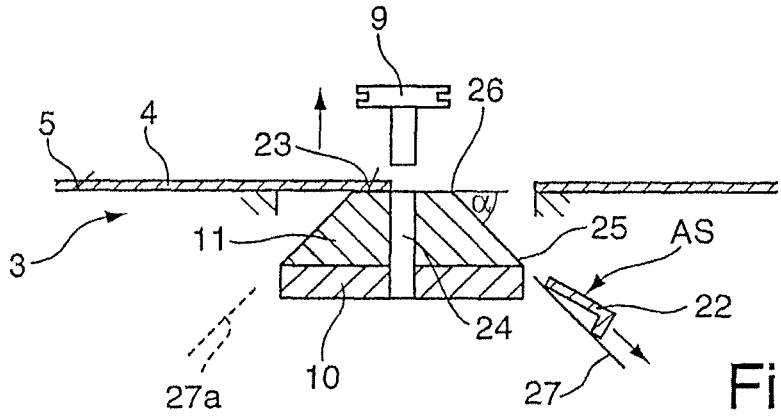
Figure 6A:
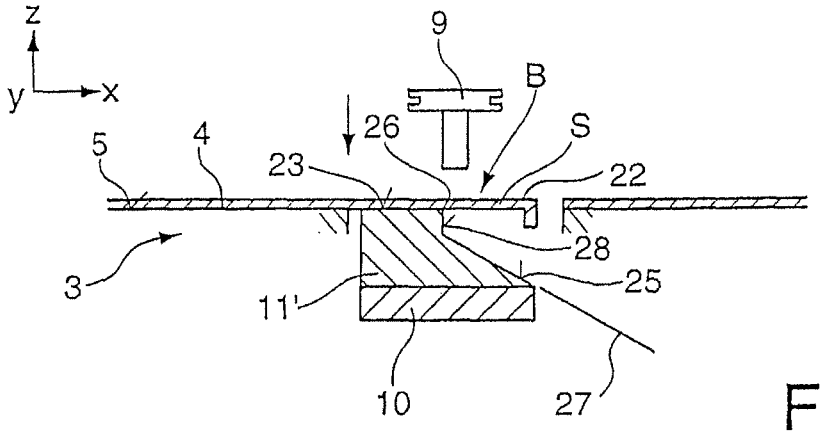
FIGS. 6*a-c* illustrate a punching operation in which a workpiece part is discharged from a remaining portion of a workpiece using the punching die of FIG. 5*a*.
Figure 6B:
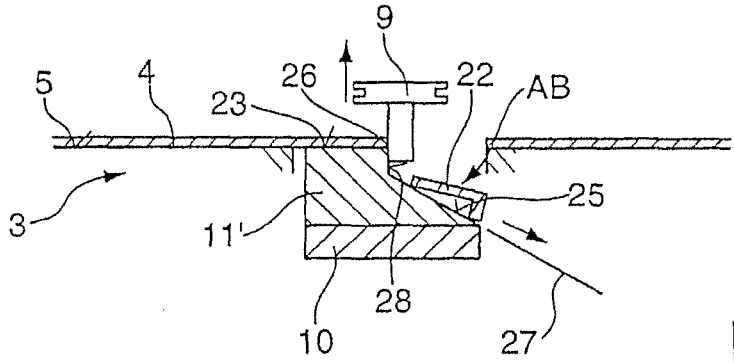
Figure 6C:
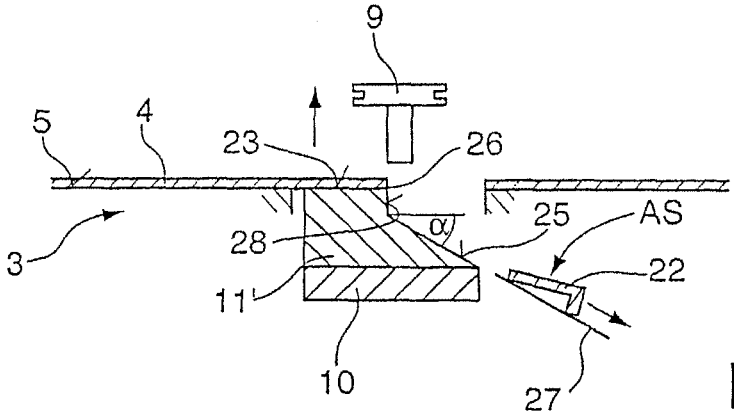

The discharging process at the punching die 11' shown in FIG. 5*a* proceeds analogously to the discharging process described with regard FIGS. 3*a-c*. As can be seen in FIG. 6*a*, the workpiece part 22 that is to be cut free, and which is situated in the processing position B, does not lie on the support surface 23 and can therefore be brought from the processing position B to the removal position AB shown in FIG. 6*b* on the discharging slope 25 by lowering the punch 9 along the die-cutting face 28 adjoining the edge 26. The workpiece part 22 then slides along the discharging slope 25 until it reaches the discharging position AS on the slide 27 adjacent to the punching die 11'. The angle $\alpha$ between the support surface 23 and the discharging slope 25 may be about 20° to about 80°.

Discharging is made possible with a high process reliability since the discharging position AS is beneath the workpiece support and the workpiece part can reliably be prevented from catching on the remaining workpiece during the above-described discharging process.

Other embodiments are within the scope of the following claims.

What is claimed is:

1. A punching die having a central axis and comprising:

a support surface for supporting a workpiece to be processed, wherein the support surface comprises an orifice for engagement by a punch;

a vertical die-cutting face formed at an edge of the support surface, wherein the orifice and the vertical die-cutting face are arranged off-center with respect to and on opposite sides of the central axis; and a discharging slope arranged for discharging a workpiece part severed from a workpiece supported on the support surface at the vertical die-cutting face, wherein the vertical die-cutting face is connected to and extends vertically upwards directly from a top horizontal edge of the discharging slope to the edge of the support surface.

2. A machine tool comprising:

a workpiece support;

a punch; and a punching die having a central axis and comprising:

a support surface for supporting a workpiece to be processed, wherein the support surface comprises an orifice for engagement by the punch and a vertical die-cutting face formed at an edge of the support surface, wherein the orifice and the vertical die-cutting face are arranged off-center with respect to and on opposite sides of the central axis; and a discharging slope;

wherein the discharging slope is configured such that a workpiece part, severed from a workpiece supported on the support surface of the punching die at the vertical die-cutting face, can be displaced, in at least one of a rotational, tilting, or linear movement, from a processing position at least partially overlying the discharging slope toward a removal position on the discharging slope, wherein the vertical die-cutting face is connected to and extends vertically upwards directly from a horizontal top edge of the discharging slope to the edge of the support surface, wherein the discharging slope is configured such that a workpiece part, severed from a workpiece supported on the support surface of the punching die, can slide toward a discharging position located beneath the support surface and adjacent the punching die, and wherein the punch has a rotational axis and comprises a cutting edge that is arranged asymmetrically with respect to the rotational axis, and wherein the cutting edge can be selectively positioned over the orifice or over the die-cutting face by rotation about the rotational axis.

3. The machine tool of claim 2, further comprising a slide arranged at the discharging position.

4. The machine tool of claim 2, further comprising a die holder configured to support the punching die, wherein a lower edge of the discharging slope abuts the die holder when the punching die is supported in the die holder.

5. The machine tool of claim 2, wherein the support surface is arranged at an angle of about 20° to about 80° relative to the discharging slope.

6. The machine tool of claim 5, wherein the support surface is arranged at an angle of about 25° to about 45° relative to the discharging slope.

7. The machine tool of claim 2, further comprising a control unit operable to control movements of a workpiece relative to the punching die allowing a workpiece part, connected to the workpiece, to be positioned such that a center of gravity of the workpiece part overlies the discharging slope.

8. The machine tool of claim 2, further comprising:

a die holder configured to support the punching die;

a punch holder configured to support the punch; and a drive unit operable to move the die holder and the punch holder relative to each other along a stroke axis.

9. A method comprising:

obtaining a machine tool of claim 2; and severing a workpiece part from a workpiece supported on the support surface of the punching die at the vertical die-cutting face, wherein the severed workpiece part is displaced, in at least one of a rotational, tilting, or linear movement, from the processing position at least partially overlying the discharging slope of the punching die toward the removal position on the discharging slope, and wherein the workpiece part slides from the removal position toward the discharging position located beneath the workpiece support and adjacent to the punching die.

10. The method of claim 9, further comprising:

supporting the punching die in a die holder; and moving the die holder along a stroke axis until the discharging slope adjoins a slide arranged at the discharging position.

11. The method of claim 9, further comprising:

positioning the workpiece part such that a center of gravity of the workpiece part overlies the discharging slope prior to severing the workpiece part from the workpiece.

* * * * *

UNITED STATES PATENT AND TRADEMARK OFFICE

CERTIFICATE OF CORRECTION

PATENT NO. : 8,499,668 B2
APPLICATION NO. : 12/581992
DATED : August 6, 2013
INVENTOR(S) : Wolfgang Laib, Eric Schneider and Stefan Buettner It is certified that error appears in the above-identified patent and that said Letters Patent is hereby corrected as shown below:

Title Page, Item 73 (Assignee), delete "TRIUMPF" and insert --TRUMPF--.

Signed and Sealed this
Fifteenth Day of October, 2013

Teresa Stanek Rea
*Deputy Director of the United States Patent and Trademark Office*